United States Patent [19]

Murray

[11] 4,006,666

[45] Feb. 8, 1977

[54] CUSHIONING DEVICE FOR A HYDRAULIC JACK

[75] Inventor: Kenneth R. Murray, Mentor, Ohio

[73] Assignee: Towmotor Corporation, Mentor, Ohio

[22] Filed: May 22, 1975

[21] Appl. No.: 580,001

[52] U.S. Cl. ..... 91/394; 91/216 R; 92/85 B

[51] Int. Cl.[2] ..... F15B 15/22; F01B 15/02

[58] Field of Search ..... 92/85 B, 143, 167, 108; 91/394, 395, 396, 25, 26, 216 R; 188/322, 284

[56] References Cited

UNITED STATES PATENTS

| | | | |
|---|---|---|---|
| 2,443,312 | 6/1948 | Geiger et al. | 91/394 |
| 2,493,602 | 1/1950 | Sterrett | 91/396 |
| 2,642,845 | 6/1953 | Stevens | 91/395 |
| 2,704,996 | 3/1955 | Peterson et al. | 91/394 |
| 2,935,051 | 5/1960 | Fuller et al. | 92/85 B |
| 2,973,744 | 3/1961 | Hennells | 91/394 |
| 3,633,465 | 1/1972 | Puster | 92/143 |
| 3,691,902 | 9/1972 | Lebzelter | 91/394 |
| 3,704,650 | 12/1972 | Berg | 91/395 |
| 3,835,753 | 9/1974 | Bunyard | 92/85 B |
| 3,887,019 | 6/1975 | Reynolds | 92/85 B |

FOREIGN PATENTS OR APPLICATIONS

| | | | |
|---|---|---|---|
| 1,351,958 | 5/1974 | United Kingdom | 91/394 |

*Primary Examiner*—Paul E. Maslousky
*Attorney, Agent, or Firm*—John W. Grant

[57] ABSTRACT

A cushioning device, for cushioning the impact between a closed end portion of a cylindrical member of a hydraulic jack and an end portion of an inner member reciprocable within the cylindrical member, including a blind bore provided in one of the end portions, an elongated plunger attached to the other end portion for telescopic entrance into the blind bore as the end portions approach each other and an orifice for metering fluid forced from the blind bore by the progressive ingress of the plunger into the bore.

2 Claims, 2 Drawing Figures

CUSHIONING DEVICE FOR A HYDRAULIC JACK

BACKGROUND OF THE INVENTION

The present invention relates to hydraulic jacks and more particularly to cushioning devices for cushioning the end of stroke movement of the hydraulic jacks.

Many multi-stage hydraulic jacks are permitted to retract under freefall conditons due to gravity loads on the jacks. Occassionally, the end of the inner rod impacts against the head of the cylinder at the end of the stroke with sufficient force to cause structural damage to the jack. Although many snubbing or cushioning devices have been proposed for cushioning the end of the stroke movement, they all use the concept of restricting the flow of fluid from the actuating chamber through the inlet-outlet port. However, such cushioning devices are not readily adaptable to multi-stage hydraulic jacks since the elements making contact at the end of the stroke are generally disposed at the end of the hydraulic jack opposite to the end containing the inlet-outlet port.

OBJECTS OF THE INVENTION

Accordingly, an object of this invention is to provide an improved cushioning device for a hydraulic jack which cushions the impact between elements of the jack at the end of the stroke.

Another object of this invention is to provide such an improved cushioning device which is selfcentering to compensate for any eccentricity of the elements of the jack and/or cushioning device.

Another object of this invention is to provide an improved cushioning device of the character described which is simple in construction, inexpensive to manufacture, and is readily adaptable for multi-stage hydraulic jacks.

Other objects and advantages of the present invention will become more readily apparent upon reference to the accompanying drawings and following description.

DESCRIPTION OF THE PREFERRED EMBODIMENT

Figure 1:
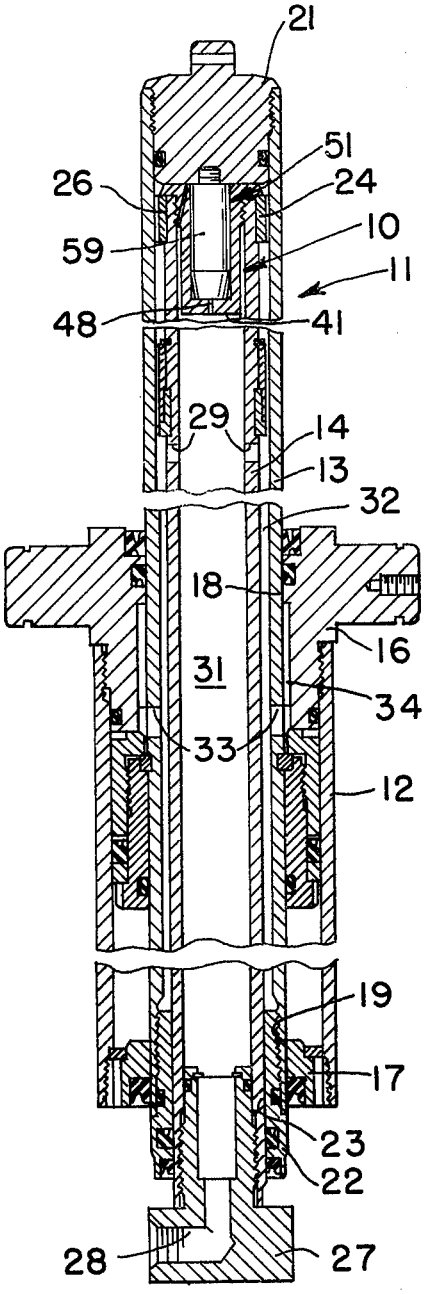
FIG. 1 is a vertical cross sectional view of the cushioning device for a hydraulic jack embodying the principles of the present invention in association with a multi-stage hydraulic jack disposed in a fully retracted position.
Figure 2:
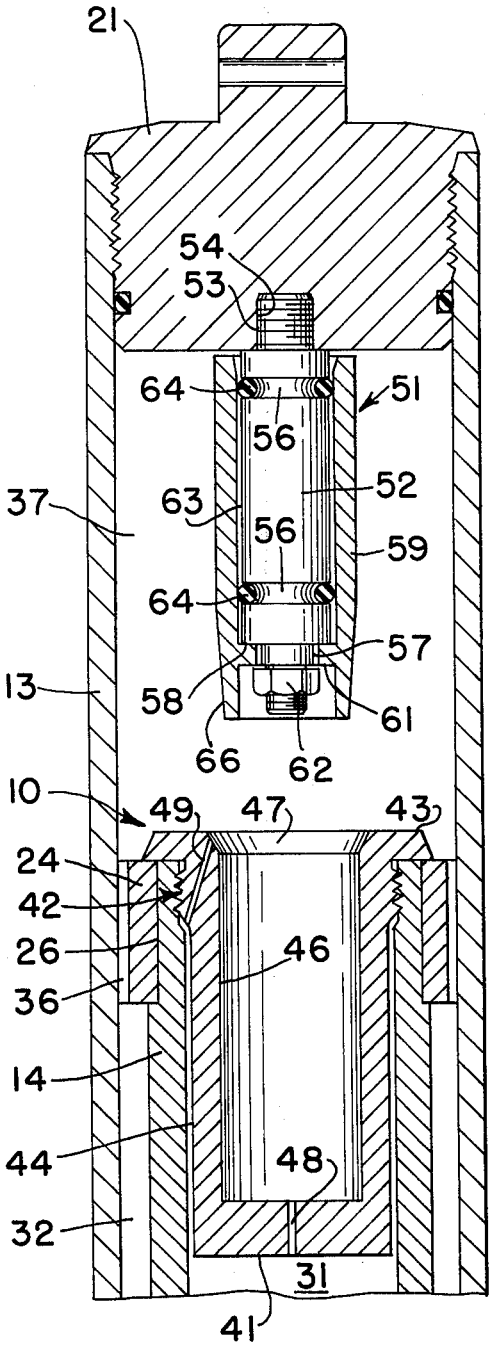
FIG. 2 is an enlarged fragmentary sectional view of the cushioning device of FIG. 1 with elements thereof in an axially expanded position.

Referring more particularly to the drawings, a cushioning device embodying the principles of the present invention is generally indicated by the reference numeral 10 in association with a multi-stage hydraulic jack 11. The jack is generally of the type described in detail in the U.S. Pat. No. 3,805,681 issued to Wible et al and assigned to the assignee of the present application. Thus, only those elements of the jack necessary for an understanding of the present invention will be described herein.

The jack 11 includes an outer elongated tubular member 12, an intermediate elongated tubular member 13 positioned within the outer member, and an inner elongated tubular member 14 positioned within the intermediate member. A pair of end caps 16 and 17 are screw threadably attached to the upper and lower end, respectively, of the outer member. The end caps define bores 18 and 19 which slidably receive the intermediate member to permit relative sliding movement between the outer and intermediate members. A head member 21 is screw threadably secured to the upper end of the intermediate member closing the intermediate member. An end cap 22 is screw threadably fixed to the lower end of the intermediate member and defines a bore 23 which slidably receives the inner member. A guide member 24 is disposed on a reduced diameter upper end portion 26 on the inner member and is slidable within the intermediate member. The bore 23 and guide member cooperate to allow relative sliding movement between the intermediate and inner member. A head member 27 is screw threadably attached to the lower end of the inner member and has an inlet-outlet port 28 formed therein. A plurality of apertures 29 are provided in the intermediate member to communicate an inner cavity 31 formed within the inner member with an annular chamber 32 formed between the inner and intermediate members. Similarly, a plurality of apertures 33 are provided in the intermediate member to communicate the annular chamber 32 with an annular chamber 34 formed between the intermediate and outer members. A plurality of longitudinal slots 36 are formed in the periphery of the guide member 24 to communicate the annular chamber 32 with a chamber 37 formed between the upper end of the inner member and the head member 21 secured to the intermediate member.

The cushioning device 10 of the present invention includes a cup-shaped bushing 41 extending into the upper end of the inner member 14 and secured therein by a threaded connection 42. A radially extending lip 43 is formed on the bushing and abuts the upper end of the inner member retaining the guide member 24 on the reduced diameter portion. A small annular space 44 is provided between the bushing and the inner member. A blind bore 46 is formed in the bushing and opens into the chamber 37. A chamber 47 is formed at the open end of the bore. The bushing includes an orifice 48 which communicates the blind bore with the inner cavity 31. A plurality of passages, one shown at 49, are formed in the bushing and communicate the chamber 37 with the annular space 44.

A plunger assembly 51 is attached to the head member 21 within the chamber 37 and is disposed in substantial axial alignment with the blind bore 46 of the bushing 41. The plunger assembly includes a stem 52 which has an external threaded portion 53 formed thereon and screw threaded into a threaded bore 54 provided in the head member. A pair of axially spaced annular grooves 56 are formed on the stem. A reduced diameter portion 57 is formed on the lower end of the stem forming a shoulder 58. A cylindrical sleeve 59 is mounted on the stem and has an inwardly extending web 61 disposed between the shoulder 58 and a nut 62 at the lower end of the stub shaft. The inner diameter of the sleeve is greater than the diameter of the stem forming an annular space 63 therebetween. A pair of elastomeric O-rings 64 are individually disposed in the annular grooves to center the sleeve on the stem. A conical taper 66 is formed on the lower end of the sleeve. The sleeve is sized to match the blind bore so that a sliding fit is provided therebetween.

Operation

While the operation of the present invention is believed clearly apparent from the foregoing description, further amplification will subsequently be made in the following brief summary of such operation. To extend the hydraulic jack 11, pressurized fluid from a suitable source, not shown, is directed through the inlet-outlet port 28 into the cavity 31, through the apertures 29 into the annular chamber 32, through the apertures 33 into the annular chamber 34 and through the plurality of slots 36 into the chamber 37. Assuming that the head member 27 is anchored, the outer member 12 will slide upwardly relative to the intermediate member 13 while the intermediate member moves upwardly relative to the inner member 14.

To retract the hydraulic jack 11, the inlet-outlet passage 28 is vented to a hydraulic tank in the usual manner. This permits the outer member 12 and intermediate member 13 to return to the position shown under gravity loads normally imposed thereon. As the head member 21 approaches the upper end of the inner member 14, the cylindrical sleeve 59 of the plunger assembly 51 telescopically enters the blind bore 46 of the bushing 41, entrapping fluid therein. Since the tapered end 66 enters the bore first, some of the fluid is expelled from the bore around the tapered portion. As the sleeve progressively ingresses into the bore, the entrapped fluid is expelled through the orifice 48. Thus, the initial entrapment of the fluid within the blind bore and restricting the expulsion of fluid therefrom provides a cushioning effect for slowing movement of the head member 21 toward the end of the inner member 14 at the end of the stroke of the hydraulic jack.

The elastomeric O-rings 63 allows slight radial movement of the sleeve relative to the stem 52 so that the sleeve will accurately and automatically selfcenter itself as it enters the bore 56.

In view of the foregoing, it is readily apparent that the structure of the present invention provides an improved cushioning device for a hydraulic jack for cushioning the end of stroke movement of a hydraulic jack. The cushioning is accomplished hydraulically by trapping a volume of fluid in a blind bore as a plunger approaches and enters the bore at the end of the stroke with the trapped fluid then being expelled through an orifice as the plunger progressively enters the bore. The plunger is resiliently mounted to permit limited radial movement thereof for selfcentering of the plunger within the bore so that perfect axial alignment between the plunger and bore is not necessary. The elements of the cushioning device are simple in design and construction thereby minimizing manufacturing costs.

While the invention has been described and shown with particular reference to the preferred embodiment, it will be apparent that variations might be possible that would fall within the scope of the present invention which is not intended to be limited except as defined in the following claims.

What is claimed is:

1. In a hydraulic jack having an elongated cylinder with a closed end portion, and an elongated tubular inner member relatively movable within the cylinder, said inner member having an end portion relatively movable toward and away from the closed end portion of the cylinder, the improvement comprising:

a cup-shaped bushing extending into the end portion of the tubular inner member, said bushing having a blind bore formed therein opening toward the closed end portion of the cylinder;

a threaded connection securing the bushing to the end portion of the inner member;

means forming a threaded bore in the closed end portion of the cylinder in axial alignment with the blind bore;

an elongated plunger attached to the closed end portion including a stem having a threaded portion thereon threaded into the threaded bore for attaching the plunger to the closed end portion in axial alignment with the blind bore, a cylindrical sleeve floatingly mounted on the stem for telescopic entrance into the blind bore as the end portions approach each other and a pair of elastomeric rings disposed between the stem and the sleeve permitting limited radial movement of the sleeve relative to the stem; and means for metering fluid expelled from the blind bore by the progressive ingress of the sleeve into the blind bore for cushioning the end of stroke movement of the hydraulic jack as the end portions approach each other.

2. The hydraulic jack of claim 1 wherein said fluid metering means is an orifice through which the fluid is expelled from the blind bore and into the inside of the tubular inner member.

* * * * *